US009055805B2

(12) United States Patent
Koutouras et al.

(10) Patent No.: US 9,055,805 B2
(45) **Date of Patent: *Jun. 16, 2015**

(54) GYM LOCKER ORGANIZER BAG

(71) Applicants: Jennifer Koutouras, Oak Park, CA (US); Kendra Christine Cunningham, Oak Park, CA (US)

(72) Inventors: Jennifer Koutouras, Oak Park, CA (US); Kendra Christine Cunningham, Oak Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/183,398

(22) Filed: Feb. 18, 2014

(65) Prior Publication Data

US 2014/0158737 A1 Jun. 12, 2014

Related U.S. Application Data

(63) Continuation-in-part of application No. 12/852,502, filed on Aug. 8, 2010, now Pat. No. 8,651,353.

(51) Int. Cl.

| | |
|---|---|
| ***A45F 3/04*** | (2006.01) |
| ***A45C 13/02*** | (2006.01) |
| *A45C 13/03* | (2006.01) |
| *A45C 7/00* | (2006.01) |
| *A45C 3/00* | (2006.01) |

(52) U.S. Cl.

CPC . *A45F 3/04* (2013.01); *A45F 3/042* (2013.01); *A45C 13/02* (2013.01); *A45C 13/03* (2013.01); *A45C 2007/0004* (2013.01); *A45C 2013/026* (2013.01); *A45C 2003/007* (2013.01); *A45C 3/004* (2013.01)

(58) Field of Classification Search

CPC ..... A45C 3/004; A45C 2003/007; A45C 2013/026

USPC ..... 224/257, 259, 580, 584, 600, 627, 645, 224/653; 383/22, 38

See application file for complete search history.

(56) References Cited

U.S. PATENT DOCUMENTS

| | | | | | |
|---|---|---|---|---|---|
| 1,684,232 | A | * | 9/1928 | Levit | 383/38 |
| 4,164,968 | A | * | 8/1979 | Esposito et al. | 224/607 |
| 4,753,329 | A | * | 6/1988 | Choy | 190/111 |
| 4,773,515 | A | * | 9/1988 | Kotkins, Jr. | 190/103 |
| 4,805,749 | A | * | 2/1989 | Gerch | 190/111 |
| 4,859,084 | A | * | 8/1989 | Kaumeyer | 383/39 |
| 4,984,662 | A | * | 1/1991 | Jacober | 190/107 |
| 5,042,664 | A | * | 8/1991 | Shyr et al. | 206/579 |
| 5,090,526 | A | * | 2/1992 | Jacober | 190/107 |
| 5,544,792 | A | * | 8/1996 | Arnwine | 224/153 |
| 5,743,447 | A | * | 4/1998 | McDermott | 224/153 |
| 6,009,995 | A | * | 1/2000 | Speck | 206/315.9 |
| 6,595,358 | B1 | * | 7/2003 | Speck | 206/315.9 |
| 6,732,863 | B2 | * | 5/2004 | Speck | 206/315.9 |

(Continued)

*Primary Examiner* — Justin Larson
*Assistant Examiner* — Peter Helvey
(74) *Attorney, Agent, or Firm* — Cislo & Thomas, LLP

(57) ABSTRACT

A utility bag having shoulder straps which allows the bag to be used as a backpack to carry clothing, shoes, wet items, personal grooming items, etc. to a gym. At the gym the utility bag can be hung up on one or more of the locker hooks and, when the front panel of the utility bag is opened, all items in the utility bag can be easily accessed without removing the bag from the locker. The bag has a number of separate internally located compartments where each compartment can have a see through mesh front panel which allows a user to see the contents of the compartment and allows air to circulate. The bag has pockets which are accessible from the outside of the bag which allow a user to quickly access a desired item such as a cell phone, wallet, etc. without opening the utility bag.

17 Claims, 6 Drawing Sheets

(56) References Cited

U.S. PATENT DOCUMENTS

| | | | | |
|---|---|---|---|---|
| 6,863,201 | B2 * | 3/2005 | Esqueda | 224/576 |
| 7,604,102 | B2 * | 10/2009 | Albritton | 190/107 |
| 2001/0017307 | A1 * | 8/2001 | Bentzen | 224/634 |
| 2002/0170935 | A1 * | 11/2002 | Annis | 224/653 |
| 2002/0179653 | A1 * | 12/2002 | Klamm | 224/153 |
| 2003/0197044 | A1 * | 10/2003 | Webb | 224/584 |
| 2003/0205601 | A1 * | 11/2003 | Kilduff | 224/627 |
| 2004/0022455 | A1 * | 2/2004 | Reason | 383/5 |
| 2004/0188482 | A1 * | 9/2004 | Wilson et al. | 224/576 |
| 2007/0119883 | A1 * | 5/2007 | Albritton | 224/153 |
| 2010/0051659 | A1 * | 3/2010 | Ferrari | 224/197 |
| 2010/0108731 | A1 * | 5/2010 | Rowe et al. | 224/654 |

* cited by examiner

GYM LOCKER ORGANIZER BAG

CROSS-REFERENCE TO RELATED APPLICATION

This patent application is a continuation-in-part application of U.S. patent application Ser. No. 12/852,502, filed Aug. 8, 2010, entitled "Gym Locker Organizer Backpack," which application is incorporated in its entirety here by this reference.

TECHNICAL FIELD

The present invention relates generally to a utility bag which is used for carrying gym clothes and, more specifically to a utility bag that can be hung up in a gym locker and, while being hung up in the locker, all of the items in the bag can be accessed without removing the bag from the locker.

BACKGROUND

Utility bags for athletic purposes are known in the prior art. More specifically, by way of example. U.S. Pat. No. 5,042,664 to Shyr discloses a soft-sided utility bag having a hinged door-like end opening and a plurality of shelves which can be used to divide the bag enclosure into two or more compartments. The shelves are supported by flexible suspension structures which can be easily displaced out of the way when not in use. The shelves can be stored within the bag when the full, undivided volume of the bag is needed. The bag is collapsible for easy storage and/or transport.

U.S. Pat. No. 4,752,008 to Pratt discloses a utility bag which is generally rectangular in shape and sized to fit into an athletic locker or under the seat of an airplane. The utility bag has a pair of transversely positioned rectangular, rigid frame members longitudinally spaced apart within the interior of the bag; a fabric side panel having a width such that the forward and rearward edges of the side panel extend beyond the opposing outside edges of the frame members where the side panel covers the frame members on the outside surfaces to form the top, bottom and sidewalls of the utility bag; a rectangular fabric end panel attached at its edges to the edges of the side to form a closed rear end wall of the utility bag; an outwardly swinging, generally rectangular fabric door attached in hinge-like fashion along one elongate edge thereof to a forward sidewall edge of a side panel of the utility hag; and zipper closure means attached to the forward edge of the side panel and the other three side edges of the rectangular fabric door for releasably securing the fabric door in a closed position to the otherwise open, front end of the utility hag.

U.S. Pat. No. 1,137,579 to Cohn discloses a valise with an open side carrying pockets on the inside and in its body portion with means to support a plurality of trays which are accessible from the top or at one side of the valise.

U.S. Pat. No. 2,018,809 to Rodgers discloses a convertible hand hag having two compartments where the bag can be converted into various shapes.

U.S. Pat. No. 2,517,757 to Adlerstein discloses a knapsack having a tubular frame for supporting shelves which are attached to the rear wall of the knapsack by sewing or with snaps.

U.S. Pat. No. 3,963,102 to Carp discloses a carry-on luggage bag of flexible material with top closure flaps interconnected with a zipper. An elongated U shaped liner is mounted on and spans the side walls of the bag, with the bottom wall of the liner spaced from the housing bottom wall to define an auxiliary storage chamber. One side wall is cut away near the auxiliary chamber to provide a side flap with a zipper. An upright divider is mounted upon the liner bottom wall to provide a first storage chamber for receiving a tote bag which can receive an umbrella.

U.S. Pat. No. 4,212,377 to Weinreb discloses a convertible utility bag which has a divider panel spaced from and parallel to the bottom of the hag to provide, in a first position, two compartments of unequal size and to provide, when swung against the back of the bag, a larger compartment.

U.S. Pat. No. 4,773,515 to Kotkins discloses a multi-compartment, expansible luggage bag having a main storage compartment with one or more expansible joints to increase the size of the main storage compartment. In conjunction with the main storage compartment, there is also provided a separable end storage compartment having an inner flexible membrane that can be extended inwardly beyond each of the expansion joints to maximize the volume of the end storage compartment when the expansion joints are open.

U.S. Pat. No. 4,805,748 to Gerch discloses a sports duffle bag having a top opening tubular body and a sidewall open top pocket sized to snugly receive the head of a tennis racket. An opening at a top corner of the pocket permits the racket handle to project from the pocket. An expansion panel is secured in the mouth of the pocket and has two flaps connected by a slide fastener so that in the open position the flaps hang in the pocket alongside the head of the racket and in the closed position the flaps are pulled above the pocket and closed over a racket head extending above the pocket to increase the height of the pocket for accommodating oversized rackets.

U.S. Pat. No. 4,805,749 to Gerch discloses an improved tube shape duffel-type travel or sports bag having an oblong softsided central compartment with access through the top, and a pair of matching smaller compartments, one each on the opposing ends of the oblong central compartment. The opposing compartments have circumferential zippered openings therearound. One of the end compartments includes a plurality of pockets/dividers and the opposing smaller compartment on the opposite end of the bag has an expansible wall. The expansible wall includes a collapsible pocket of waterproof material, which is capable of extending into the main compartment and expanding therein as desired, preferably for positioning worn clothing or accessories therein,

SUMMARY

The invention of the present application is directed towards a utility bag, also referred to as a backpack, having a generally rectangular shape to fit within a gym locker, the utility bag comprising: a top panel; a first side panel adjacent to the top panel; a second side panel opposite the first side panel and adjacent to the top panel; a rear panel adjacent to the top panel, the first side panel, and the second side panel; a bottom panel opposite the top panel and adjacent to the first side panel, the second side panel, and the rear panel; a front panel opposite the rear panel and adjacent to the top panel, the first side panel, the second side panel, and the bottom panel, wherein the front panel is hingedly attached to the bottom panel, and reversibly attached to the first side panel, the second side panel, and the top panel so as to adopt a closed configuration when the front panel is attached to the top panel, the first side panel, and the second side panel, and an opened configuration when the front panel is detached from the top panel, the first side panel, and the second side panel; and shoulder straps attached to at least one of the first or second side panels for carrying the utility bag as a backpack, wherein the interior of the utility bag has at least two compartments each having an opening that is accessible when the front panel is in the open configuration, wherein the opening of at least one of the at least two compartments is substantially and reversibly closed by a see through covering.

In an exemplary embodiment of the present invention, there is disclosed a utility bag having a substantially rectangular shape which is adapted to fit within a gym locker comprising: a substantially rectangular top panel of fabric having a front end, a rear end and two side ends wherein the narrow dimension of the rectangular panel is the front and rear ends of the top panel and the wide dimension of the rectangular panel is the sides of the top panel; first and second side panels of substantially rectangular fabric having top ends, bottom ends and side ends wherein the top ends of the narrow dimension of the side panels are attached to the wide dimension of the first and second side ends of the rectangular top panel; a substantially rectangular rear panel of fabric having a top end, a bottom end and side ends wherein the top end of the narrow dimension of the rectangular rear panel is attached to the narrow rear end of the top panel, and the side ends of the rear panel are attached to side ends of the first and second side panels; a rectangular substantially rigid bottom panel having a front end, a rear end and two side ends wherein the narrow dimension is the front and rear ends of the bottom panel and the wide dimension is the sides of the bottom panel, and wherein the rear end of the bottom panel is attached to the bottom end of the rear panel and the side ends of the bottom panel are attached to the bottom ends of the first and second side panels; a substantially rectangular front panel of fabric having a top end, a bottom end and two side ends wherein the bottom end of the narrow dimension of the rectangular panel is swingably attached to the front end of the bottom panel and the two side ends of the front panel are removably connected to the side ends of the first and second side panels and the top end of the front panel is removably connected to the front end of the top panel; wherein the interior of the utility bag has at least three compartments each being accessible only when the top end and two side ends of the front panel is not attached to the top panel and the side panels; and shoulder straps attached to the top and bottom ends of the first side panel for carrying the utility bag as a backpack.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

There is disclosed a utility bag (also referred to as a backpack) which can be carried on a person's shoulders as a backpack and has separate compartments for carrying, for example, clothes, shoes, wet items, personal grooming items, a gym card, a lock, a cell phone, etc. which are normally used when working out at a gym. The backpack can be carried on a person's shoulders as he/she goes to the gym and, upon arriving at the gym, removes the backpack from his/her shoulders and hangs it on a bar or hook in a gym locker. The backpack has a generally rectangular shape where the width of the backpack is less than the width of the gym locker and the depth of the backpack is less than the depth of the gym locker. Thus, the backpack has a size and configuration that fits easily into a gym locker and can be hung on a bar or hook in the locker with the front of the utility bag facing the front of the locker and the items in the hag being accessible without removing the bag from the locker.

The utility bag has separate compartments and various pockets for hems such as shoes, sneakers, toiletries, gym clothing, etc. When a person enters a gym and places the bag into a gym locker, he/she opens the front of the bag and, without removing the bag from the locker, removes various items from the bag for use while in the gym. At the same time, he/she can place street items into the hanging bag for temporary storage. The compartments can be opened and closed with their own fastener, such as snap or slide fastener, and the various compartments have a mesh covering for viewing the contents of the compartments and/or for breathing. In addition to the compartments which are located within the utility hag, one or more pockets of different depths are provided which are accessible from the outside of the bag to allow the user to quickly and easily reach a gym card, a cell phone, a wallet or other items without opening the hag. In addition to the pockets which are accessible from the outside of the bag, at least one small pocket is located on at least one of the shoulder straps of the bag for receiving a small item such as a car or house key, a cell phone, etc. Pockets on the inside of the bag may also be used.

Figure 1:
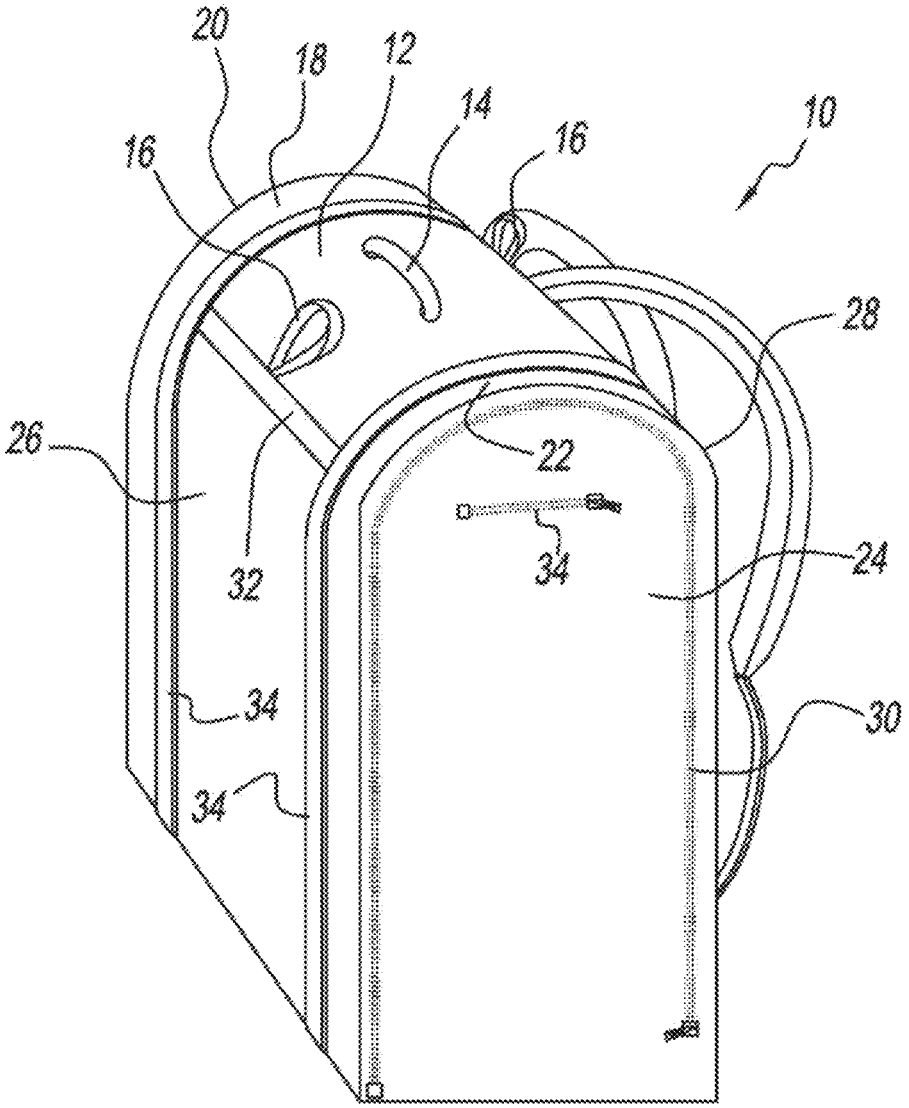
FIG. 1 is a perspective view showing the front of a gym locker organizer backpack in accordance with the principles of the invention.
Figure 2:
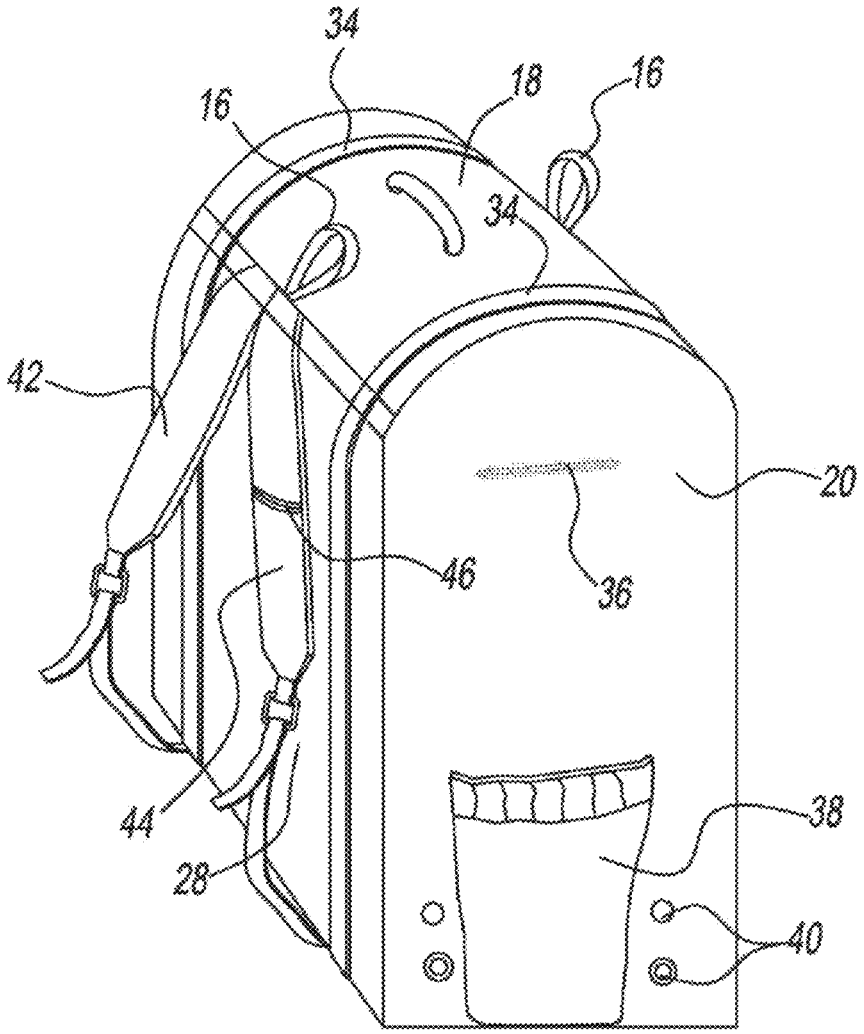
FIG. 2 is a perspective view showing the rear of the gym locker organizer backpack of FIG. 1 in accordance with the principles of the invention.

Referring to FIG. 1, there is shown a perspective view of the front of a preferred embodiment of the utility bag 10 which is used as a gym locker organizer backpack in accordance with the principles of the invention. In the preferred embodiment, the utility bag has a curved top panel 12, a padded carrying handle 14 centrally located at the top of panel 12, and a loop 16, and preferably two loops 16, with one located at each side of the top panel 12. Preferably, the loops 16 are bilaterally arranged on opposite sides of the top panel approximately midway between the front panel 24 and the rear panel 20 for hanging the utility bag on at least one hook in a gym locker. Preferably, each loop 16 is comprised of a length of webbing whose ends are attached to the utility bag 10 such that at the point where the webbing is attached to the bag, the webbing is adjacent along its length, or as shown in FIG. 2, overlapping. Preferably, each loop 16 has an exposed webbing length between 4 inches and 12 inches, and more preferably between 6 inches and 10 inches. The top panel 12 has a rectangular shape where a back end 18 is permanently attached to a back panel 20 of the utility bag and the front end 22 which is removably or reversibly attached to a front panel 24 of the utility bag. One side edge of the top panel 12 is permanently attached to a side panel 26 and the other side edge of the top panel 12 is permanently attached to another side panel 28. Any combination of the top panel 12, back panel 20, side panels 26, 28, and bottom panel can be attached by being integrally formed as a single piece of material. Accordingly, the utility bag comprises a curved top panel 12, a back panel 20 adjacent to the top panel 12, a front panel 24 opposite the back panel 20 and adjacent to the top panel 20, a first side panel 26 adjacent to the top panel 12, the back panel 20, and the front panel 24, and a second side panel 28 opposite the first side panel 26 and adjacent to the top panel 12, the back panel 20, and the front panel 24.

The utility bag 10 further comprises a bottom panel 21 adjacent to the back panel 20, side panels 26, 28, front panel 24, and opposite the top panel 12. The bottom end of back panel 20, side panel 26, side panel 28 and front panel 24 may be permanently attached, for example, by stitching, with adhesives, or by being integrally formed therewith, and the like, to the bottom panel of the utility hag 10.

A fastener, such as a zipper 30 having one or two pulls for opening and closing the zipper, reversibly attaches the front panel 24 to the side panels 26, 28 and the top panel 12. When the front panel 24 is not attached with the closed zipper to the side and top panels, the bottom end of the front panel 24 folds down along its bottom edge, and the front panel 24 falls down below the bottom of the bag.

Reinforcing straps 32 are provided between the curved top panel 12 and the side panels 26, 28, and provide additional attachment support to the connection of loops 16 to the bag. Two reinforcing straps 34 having a preferred width of about one and one-half inches extend around the sides and top of the bag. Preferably, straps 34 are located about one and one-half inches from the front and back edges of the side and top panels and can have a decorative design in a color that blends with the color of the side panels 26, 28 and the top panel 12. For example, if the utility bag is black, the straps can be black and the design on the straps 32 can be in silver. A pocket 34 which is accessible from the outside of the bag and can be closed with a zipper, snap, hook and loop fastener, hook, magnet, etc., is located on the front panel 24.

Referring to FIG. 2, there is shown a perspective view of the rear of the gym locker organizer backpack of FIG. 1. The rear panel 20 has a pocket 36 located near the top of the bag and which is accessible from the outside of the rear panel 20. Pocket 36 can be closed with a zipper, snap, hook and loop fastener, hook, magnet, etc. An externally ally located pocket 38 positioned near the bottom of the bag has an elastic cuff located at its top edge for closing the top end of the pocket 38, but other fastening mechanisms can be used. A user can access an article which is located in pocket 38 by simply inserting his/her hand past the elastic cuff and into the pocket. Small circular vent openings 40 located on each side of pocket 38 allow air to circulate within the bag. The vent openings can include circular grommets having a metal screen center. The inside of the bag may also have one or more pockets 90, which may be securely attached to the bag or reversibly attached via a reversible fastener 76, such as a hook and loop fastener, snaps, zippers, hooks, magnets, or other suitable apparatus. Such pockets may be open, gathered at the top with elastic or drawstring, or reversibly closed with a zipper, hook and loop fastener, snaps or other suitable apparatus.

To allow the utility bag to be used as a backpack, shoulder straps 42, 44 are provided along side 28 of the utility bag. The top portions of the straps 42, 44 are padded for comfort and each strap 42, 44 has a buckle for adjusting the length of the shoulder straps 42, 44. Located on either one or on each of the shoulder straps is a small pocket 46 which has an elastic cuff top which keeps the top of the pocket closed. A zipper, snap, hook and loop fastener, hook, magnet, etc. can also be used. This pocket 46 can be used to hold a user's cell phone, keys for his/her car and/or house or any other small item. In some embodiments, the straps 42, 44 may be reversibly attached to the bag.

Figure 3:
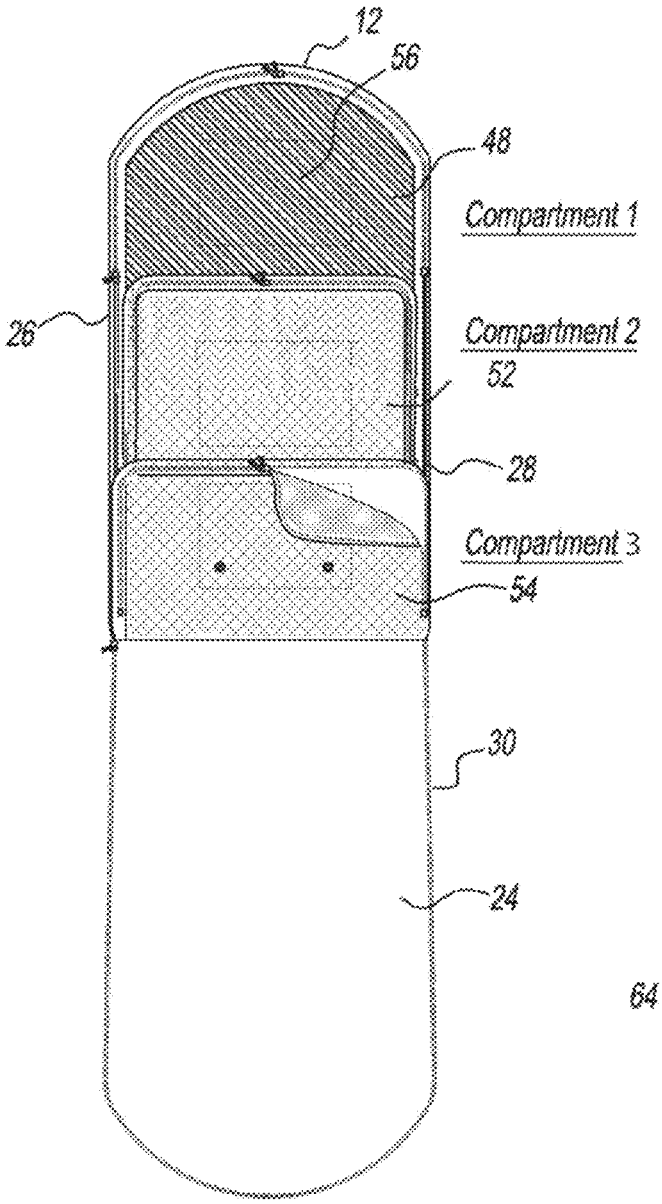
FIG. 3 is a view looking into the open front of the gym locker organizer backpack of FIG. 1 showing the various compartments where the front of the knapsack is hanging down in accordance with the principles of the invention.

Referring to FIG. 3, there is a view looking into the open front of the gym locker organizer backpack of FIG. 1 showing three compartments when the front panel 24 of the backpack is not attached to the side and top panels 26, 28, 12, respectively, and folds down along its bottom end to hang below the bag, where it can swing freely. As such, the front panel 24 is referred to as being hingedly attached or formed with the bottom panel to reflect this ability of the front panel to fold up and down. As such, the term hingedly is broadly construed to cover any mechanism (stitching, foldable material, living hinge, hinge mechanism, and the like) that allows the front panel 24 to fold down below or even under the bottom panel.

In some embodiments, a strap 80 may be provided inside the bag on or near the bottom panel towards the front of the bag so that the front panel 24, when in the open configuration, can be roiled or wrapped up and fastened with the strap against the bottom panel, for example, to keep the front panel from hanging freely. The strap 80 can have a typical fastener 82, such as a hook and loop fastener, snap buttons, magnets, and the like to fasten the free end of the strap to itself or to the bottom panel.

The interior of the gym locker organizer backpack shown in FIG. 3 has three compartments 48, 52 and 54. However, in some embodiments, the bag 10 may have one compartment, two compartments, or more than three compartments.

The floor or base 70*a-c* of each compartment may be formed from a substantially rigid corrugated plastic material 72, which may be located within a fabric pocket or envelope 74, which pocket or envelope may be permanently sewn shut or reversibly secured with zippers, hook and loop fasteners, or the like. The floor or base 70 *a-c* of each compartment may be permanently or removably fixed in position and attached to the bag interior with a reversible fastener 76, such as a zipper, snap, hook and loop fastener, hook, magnet, etc. The fabric pocket 74, the substantially rigid material 72, or both may be attached to the bag interior in such manner. Making the compartment floor 70 *a-c* removable permits the bag to be configured into a smaller package for shipping and storage, and also allows the user to customize the bag by varying the number and size of the compartments. The corrugated material provides a relatively stiff non-sagging floor for each compartment, which helps to provide a bag that is made of fabric to maintain its width dimension, even when each compartment is only partially filled. The floor of any compartment can be made from any other relatively rigid material such as foam, wood, metal, and the like.

The top compartment 48 may have a front panel that comprises a see-through mesh fabric 56, preferably made of nylon, which can be positioned over and close the front of the compartment with a fastener, preferably a zipper having a double pull where the zipper extends along the top and two sides of the top compartment 48. When the two pulls are used to open the zipper on the front of the top compartment, the see-through mesh fabric folds along its bottom edge and hangs down below the floor of the top compartment 48 (like the front panel is to the bottom panel) to allow a user to either retrieve an item from, or insert an item into the top compartment 48 without having to remove the hag from the locker.

Top compartment 48 can be used for dry clothes or other items. Second compartment 52, which is located immediately below the top compartment 48, can be used for a cosmetic case, for toiletries, and/or for personal items. A pull out bag made of water resistant material such as nylon and having a fold-over or zippered, leak-resistant closure is provided (not shown) for holding damp or wet clothes which may be placed in the second compartment 52. The water-resistant, pull-out hag is provided to prevent water from wet clothing from dripping onto articles into any third or lower compartment 54, which can be used for holding sneakers or shoes. Any compartment, such as the second compartment 52 or third compartment 54 can have a similar front panel and fastener as described for the top compartment 48. The above-described features and uses may also be applied to embodiments that have other than three compartments.

Figure 4:
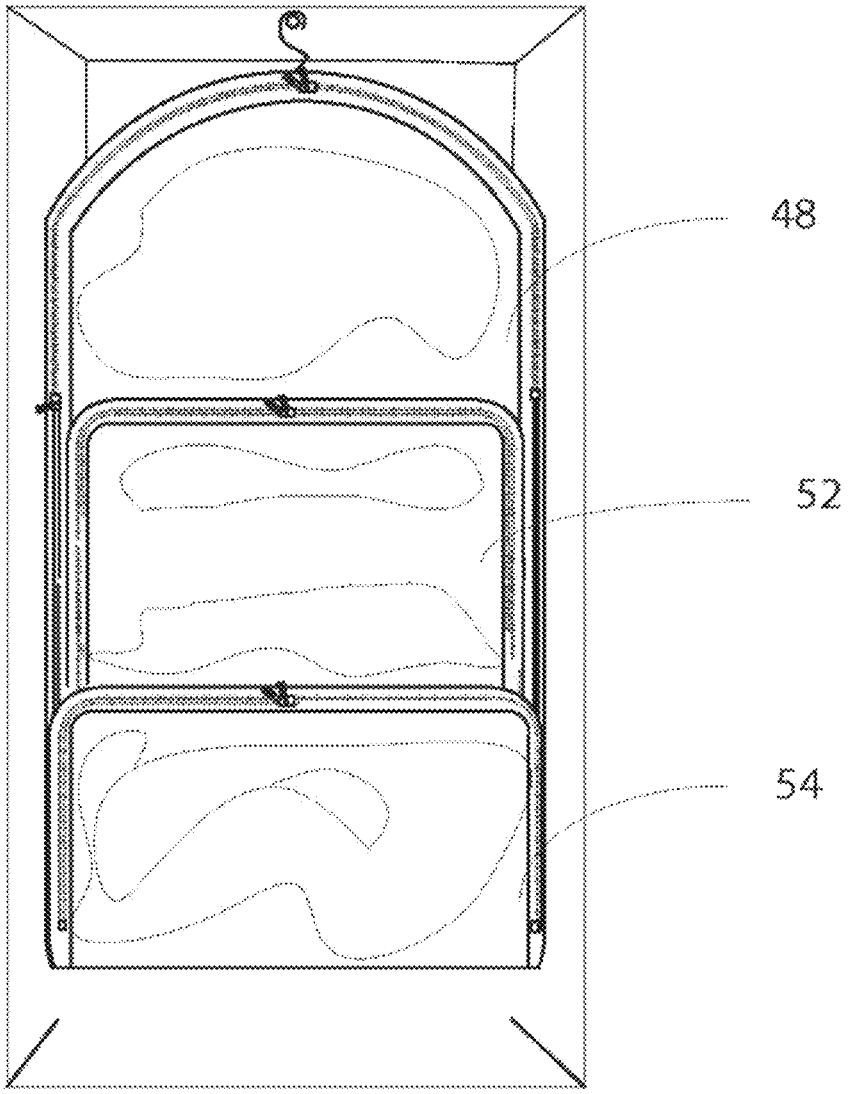
FIG. 4 is a view of the gym locker organizer backpack of FIG. 1 in use hanging in a gym locker with various user items and articles of gym attire neatly and conveniently compartmentalized in different compartments in accordance with the principles of the invention.
Figure 6:
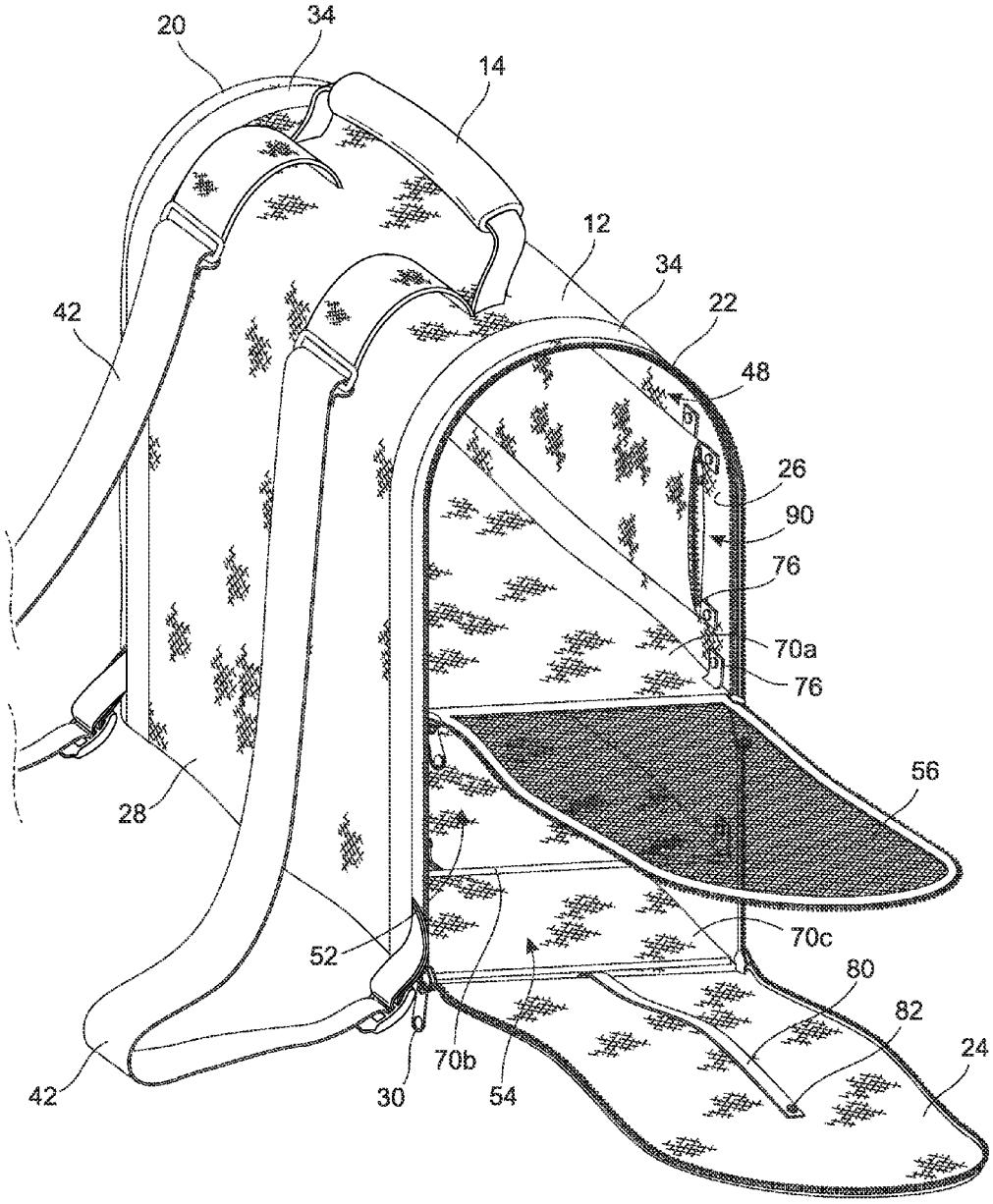
FIG. 6 is a perspective view of another embodiment of the present invention.
Figure 7:
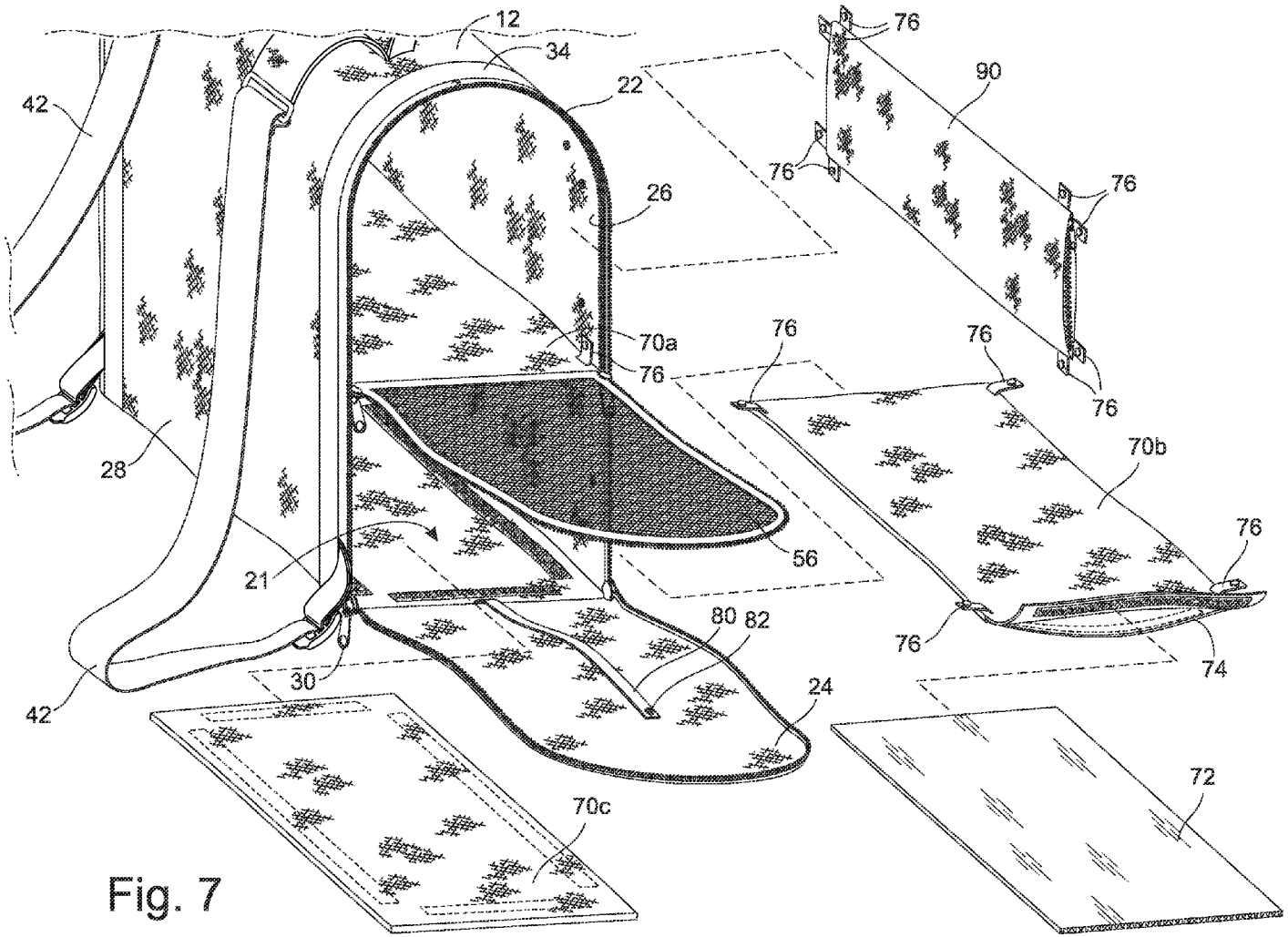
FIG. 7 is an exploded view of the embodiment shown FIG. 6.

FIG. 4 is a view of the gym locker organizer backpack of FIG. 1 in use hanging in locker with various user items and articles of gym attire neatly and conveniently compartmentalized in different compartments in accordance with the principles of the invention. In use, a person with the gym locker organizer backpack here disclosed goes to a gym and opens the door of a gym locker. Gym lockers are normally 9 inches, 12 inches or 15 inches wide where most lockers are 12 inches wide. In the preferred embodiment, hag 10 is substantially eight and one half inches wide and, therefore, can be placed into any standard gym locker. A gym locker will normally have a hook on each side wall which can be used for hanging the bag. The bag can be inserted into and hung up in the locker by placing the clothes loops 16, see FIG. 1, located at the top of the bag onto the hooks on the side walls of the gym locker. If, however, the locker has a hook attached to the top of the locker, the gym locker organizer backpack can be hung from the hook 60 shown in FIG. 5, which can be provided with the gym locker organizer backpack. Hook 60 shown in FIG. 5 has a top hook 62 for placement on a hook, which is located at the top of a gym locker, and side hooks 64, 66, which are for holding the loops 16 or handle 14 on the utility bag 10.

Figure 5:
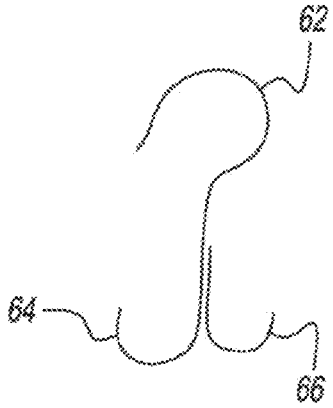
FIG. 5 is a side view of a hook which can be used to hang the gym locker organizer backpack of FIG. 1 from a gym locker hook.

In addition to the hook of FIG. 5, to provide hanging versatility and flexibility, an extension strap, which can have a length of about thirty five inches and a fastener, such as a snap, hook, Velcro, etc., at each end (not shown) can also be provided with the gym locker organizer backpack 10.

The fabric from which the various panels are made is preferably a fabric made of nylon which may have a water proof inner surface.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A utility bag having a substantially rectangular shape which is adapted to fit within a gym locker, comprising;

a. a substantially rectangular top panel of fabric having a front end, a rear end and two side ends wherein the narrow dimension of the rectangular top panel is the front and rear ends of the top panel and the wide dimension of the rectangular panel is the side ends of the top panel;

b. first and second side panels of substantially rectangular fabric having top ends, bottom ends and side ends wherein the top ends of the narrow dimension of the side panels are attached to the wide dimension of the first and second side ends of the rectangular top panel, respectively;

c. a substantially rectangular rear panel of fabric having a top end, a bottom end and side ends wherein the top end of the narrow dimension of the rectangular rear panel is attached to the narrow rear end of the top panel, and the side ends of the rear panel are attached to side ends of the first and second side panels, respectively;

d. a rectangular substantially rigid bottom panel having a front end, a rear end and two side ends wherein the narrow dimension is the front and rear ends of the bottom panel and the wide dimension is the side ends of the bottom panel, and wherein the rear end of the bottom panel is attached to the bottom end of the rear panel and the side ends of the bottom panel are attached to the bottom ends of the first and second side panels, respectively;

e. a substantially rectangular front panel of fabric having a top end, a bottom end and two side ends wherein the bottom end of the narrow dimension of the rectangular front panel is swingably attached to the front end of the bottom panel, and the two side ends of the front panel are removably connected to the side ends of the first and second side panels, respectively, and the top end of the front panel is removably connected to the front end of the top panel; and f. shoulder straps attached to the top and bottom ends of the first side panel for carrying the utility bag as a backpack, g. wherein the interior of the utility bag has at least two compartments each having an opening that is accessible only when the top end and two side ends of the front panel is not attached to the top panel and the side panels, wherein the opening of at least one of the two compartments is substantially and reversibly closed by a see through covering.

2. The utility bag of claim 1 wherein the two side ends and the top end of the front panel are removably connected to the side ends of the first and second side panels and the top end of the front panel with a slidable connector.

3. The utility hag of claim 1 further comprising a carry handle attached to the top panel of fabric.

4. The utility bag of claim 1 wherein said at least two compartments are linearly arranged in a vertical manner.

5. The utility bag of claim 1 wherein each side end of the top panel has attached to it a loop of fabric, each loop comprising a length of fabric with two ends, for hanging the utility bag on at least one hook in a gym locker, wherein the two ends of each loop of fabric are attached to utility bag immediately adjacent to each other.

6. The utility bag of claim 1 wherein a pocket is located in at least one of the shoulder straps.

7. The utility bag of claim 1 wherein each compartment has a floor of generally rigid material.

8. The utility bag of claim 7 wherein said generally rigid material is located in a fabric envelope.

9. A utility bag having a generally rectangular shape to fit within a gym locker, the utility bag comprising:

a. a top panel;

b. a first side panel adjacent to the top panel;

c. a second side panel opposite the first side panel and adjacent to the top panel;

d. a rear panel adjacent to the top panel, the first side panel, and the second side panel;

e. a bottom panel opposite the top panel and adjacent to the first side panel, the second side panel, and the rear panel;

f. a front panel opposite the rear panel and adjacent to the top panel, the first side panel, the second side panel, and the bottom panel, wherein the front panel is hingedly attached to the bottom panel, and reversibly attached to the first side panel, the second side panel, and the top panel so as to adopt a closed configuration when the front panel is attached to the top panel, the first side panel, and the second side panel, and an opened configuration when the front panel is detached from the top panel, the first side panel, and the second side panel; and g. shoulder straps attached to at least one of the first or second side panels for carrying the utility bag as a backpack, h. wherein the interior of the utility bag has at least two compartments each having an opening that is accessible when the front panel is in the open configuration, wherein the opening of at least one of the at least two compartments is substantially and reversibly closed by a see through covering.

10. The utility bag of claim 9 further comprising a handle attached to the top panel.

11. The utility bag of claim 9 wherein said at least two compartments are linearly arranged in a vertical manner.

12. The utility bag of claim 9 further comprising two loops bilaterally arranged on opposite sides of the top panel approximately midway between the front panel and the rear panel for hanging the utility bag on at least one hook in a gym locker.

13. The utility bag of claim 9 wherein a pocket is located in at least one of the shoulder straps.

14. The utility bag of claim 9 wherein each compartment has a floor of generally rigid material.

15. The utility bag of claim 14 wherein said generally rigid material is located in a fabric envelope so as to be removable.

16. The utility bag of claim 14 wherein the floors are removable from their respective compartments.

17. The utility hag of claim 9 further comprising a strap inside the bag on the bottom panel to keep the front panel roiled up under the bag when in the open configuration.

* * * * *